US007784871B2

(12) United States Patent
Cochran

(10) Patent No.: US 7,784,871 B2
(45) Date of Patent: Aug. 31, 2010

(54) OCCUPATIONAL SUPPORT SYSTEM

(76) Inventor: Dennis Cochran, 560 Ridgemont Dr., El Paso, TX (US) 79912

( * ) Notice: Subject to any disclaimer, the term of this patent is extended or adjusted under 35 U.S.C. 154(b) by 12 days.

(21) Appl. No.: 12/328,506

(22) Filed: Dec. 4, 2008

(65) Prior Publication Data

US 2009/0167072 A1 Jul. 2, 2009

Related U.S. Application Data

(60) Provisional application No. 60/016,655, filed on Dec. 26, 2007.

(51) Int. Cl.
*A47C 1/00* (2006.01)
*A47C 7/14* (2006.01)
*A47C 7/38* (2006.01)
*A61G 15/00* (2006.01)

(52) U.S. Cl. ..... 297/338; 297/337; 297/340; 297/344.16; 297/344.19; 297/195.11; 297/284.3; 297/423.11; 297/423.12; 297/487; 297/452.63; 297/392

(58) Field of Classification Search ..... 297/452.63, 297/337, 338, 340, 344.16, 344.19, 195.11, 297/392, 423.11, 423.12, 487, 488, 284.3
See application file for complete search history.

(56) References Cited

U.S. PATENT DOCUMENTS 538,407 A * 4/1895 Browne ..... 297/338 X
D149,798 S * 6/1948 Crawford ..... 297/452.63 X
2,637,371 A * 5/1953 Boutin ..... 297/344.18 X
3,029,106 A * 4/1962 Mcguire ..... 297/344.19 X
3,112,137 A * 11/1963 Drenth ..... 297/284.3
3,150,898 A * 9/1964 Knudson ..... 297/344.16 X
3,166,282 A * 1/1965 Nolan ..... 297/344.19 X
3,256,036 A * 6/1966 Nolan ..... 297/344.19 X
3,286,970 A * 11/1966 Nolan ..... 297/344.19 X
3,565,482 A * 2/1971 Blodee ..... 297/452.63 X
3,596,982 A * 8/1971 Grams ..... 297/344.17 X
3,698,673 A * 10/1972 Olsen ..... 297/330 X
3,754,787 A * 8/1973 Garber ..... 297/195.11
3,877,750 A * 4/1975 Scholpp ..... 297/452.63 X
4,650,249 A * 3/1987 Serber ..... 297/423.11 X
4,699,423 A * 10/1987 Fitzig et al. ..... 297/392 X (Continued)

FOREIGN PATENT DOCUMENTS

DE 3401314 A1 * 7/1985

(Continued)

*Primary Examiner*—Rodney B White
(74) *Attorney, Agent, or Firm*—Kermit D. Lopez; Luis M. Ortiz; Ortiz & Lopez, PLLC

(57) ABSTRACT

An occupational support chair system and method that provides frontal support to a user. The support chair system includes a lower support frame composed of a dual section hydraulic frame and an upper support frame. The upper support frame can be configured as a spinal column associated with a number of individual locking segments. The upper support frame further includes a breast support and a removable chin support in order to provide frontal support to the user. An adjustable swivel seat can be attached to the upper support frame to relieve stress and fatigue stemming from prolonged periods of standing. The support chair system further includes a stabilizing base segment, which comprises retractable wheels and a housing for batteries, electrical and computer components.

17 Claims, 3 Drawing Sheets

U.S. PATENT DOCUMENTS 4,768,831 A * 9/1988 Liedberg et al. ..... 297/344.19
5,054,852 A * 10/1991 Tholkes ..... 297/423.12 X
5,103,509 A * 4/1992 Richards ..... 4/564.1
5,228,747 A * 7/1993 Greene ..... 297/284.3
5,261,725 A * 11/1993 Rudolph ..... 297/361.1
5,295,728 A * 3/1994 Schaevitz ..... 297/423.12 X
D347,604 S * 6/1994 Ernst et al. ..... D12/132
5,328,245 A * 7/1994 Marks et al. ..... 297/284.3
D356,527 S * 3/1995 Wohnsen et al. ..... D12/128
5,490,716 A * 2/1996 Naughton ..... 297/423.12
5,628,546 A * 5/1997 Boetzkes ..... 297/316
5,636,899 A * 6/1997 Schiff et al. ..... 297/344.19 X
5,697,668 A * 12/1997 Chao ..... 297/172
5,702,158 A * 12/1997 Mengshoel et al. ..... 297/338 X
6,017,089 A * 1/2000 Mengshoel ..... 297/338
6,155,642 A * 12/2000 Kawakami et al. ..... 297/344.16
6,302,482 B1 * 10/2001 Moll et al. ..... 297/340
6,419,319 B1 * 7/2002 Sakurai ..... 297/344.12
6,439,657 B1 * 8/2002 Tholkes ..... 297/344.19 X
6,609,754 B2 * 8/2003 Rajasingham ..... 297/284.3
6,752,460 B2 * 6/2004 Looser ..... 297/338
6,910,736 B2 * 6/2005 White ..... 297/284.3
6,942,296 B2 * 9/2005 Lingegård et al. ..... 297/337 X
7,036,512 B2 * 5/2006 Harnois ..... 128/845
D527,557 S * 9/2006 Reimers ..... D6/502
7,140,684 B2 * 11/2006 Wagner et al. ..... 297/344.16
7,222,832 B2 * 5/2007 Welker ..... 297/344.16 X
7,273,252 B2 * 9/2007 Iijima et al. ..... 297/284.3
7,488,033 B1 * 2/2009 Wang ..... 297/195.11
2004/0256899 A1 * 12/2004 Moore et al. ..... 297/284.3

FOREIGN PATENT DOCUMENTS

FR 2595224 A1 * 9/1987
FR 2697418 A1 * 5/1994
JP 58202134 A * 11/1983

* cited by examiner

OCCUPATIONAL SUPPORT SYSTEM

CROSS-REFERENCE TO PROVISIONAL APPLICATION

This application claims priority under 35 U.S.C. §119(e) to U.S. Provisional Patent Application No. 61/016,655 filed on Dec. 26, 2007 and entitled "Occupational Support System," which is hereby incorporated by reference in its entirety.

TECHNICAL FIELD

Embodiments are generally related to adjustable support chairs suited for use in medical and dental applications, beauty parlors, barbershops, and so forth.

BACKGROUND OF THE INVENTION

Adjustable chairs are utilized in a wide variety of applications such as, for example, medical and dental applications, beauty parlors and barbershops, and the like, in order to provide an efficient and comfortable treatment. In medical and dental applications, for example, the adjustable chair is utilized to support a patient's body in an upright, supine position (reclined position with nose and knees on the same plane) or sub-supine position (reclined position with head lower than the feet), which can be a well, organized position for treatment.

Conventional adjustable chairs provide sufficient comfort to the patients, but are not very useful to the surgeons, doctors and dentists. For example, dentists and dental assistants working in dental clinics have suffered from back problems for years due to many hours leaning and twisting over patients while performing precise and delicate work on the patients' teeth. Holding up the arms for prolonged periods of time creates further stress and tension on the lower back, shoulders and neck resulting in stinging pains in these areas. Hence, surgeons, doctors and dentists may be forced to quit their respective occupations due to lower back, neck and shoulder problems stemming from years of leaning over surgery tables and standing or sitting for prolonged periods.

Adjustable chairs that possess supports for engaging a user, such as a dentist, hygienist, surgeon, etc., are known in the art. The majority of prior art support chair systems include a lumber back support, which does not provide an endurable amount of support for a user's weight from the front. Such chairs typically do not attain their intended purpose of back support due to erroneous design problems. That is, the support system for such devices generates a huge strain at the lower back and shoulders of the user while leaning over, for example, a patient. Such support chair assemblies suffer from a number of disadvantages, including a limited freedom of movement when a user is seated on the chair and performs a work task forward of the seating surface. The seat of the chair must provide comfort to the user particularly when working long hours in a forwardly inclined position.

Based on the foregoing it is believed that a need exists for an improved occupational support chair system for supporting a user's weight from the front, as described in greater detail herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved adjustable chair system.

It is another aspect of the present invention to provide for an improved occupational support chair system for supporting the weight of a user from his or her front.

The aforementioned aspects and other objectives and advantages can now be achieved as described herein. An occupational support chair system that provides a frontal support to a user is disclosed. The support chair system can be configured to include a lower support frame composed of a dual section hydraulic frame and an upper support frame. The upper support frame can be configured in the form of a spinal column associated with a number of individual locking segments. The upper support frame can further include a breast support and a removable chin support in order to provide frontal support to the user. An adjustable swivel seat can be attached to the upper support frame to relieve stress and reduce fatigue stemming from prolonged periods of standing. The support chair system further includes a stabilizing base segment, which can include retractable wheels and a housing for batteries, electrical and computer components.

The upper support frame can include the use of a balancing sensor and a motion sensor, which can be utilized to detect the user's intent and to automatically adjust the position of the support system in accordance with a user's movement. The upper support frame can effectively reduce the strain at the lower back and shoulders of the user by changing its position. The breast support further includes individual rib segments that can be adjusted in and out in order to accommodate larger frames. The breast support can also be padded with technology foam for comfort. The dual section hydraulic frame of the lower support frame can be utilized to lift the user into a comfortable position.

The stabilizing base segment can be disposed in a horizontal plane and extend at a substantially common angle from the lower support frame to provide support to the support chair system. The retractable wheels of the stabilizing base segment can be deployed by the user by means of weight. The support system can be swiveled by lifting the weight of the user from the seat so that wheels in the stabilizing base segment can be deployed. The weight on the seat can cause the wheels to retract when the user is in an appropriate position, by rendering the support system immobile. The swivel adjustable seat can support the user's weight in a standing position through the use of an adjustable and pivoting mechanism. Such support system provides frontal breast support to relieve strain from the lower back and shoulders as a user leans over a patient or other subject.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
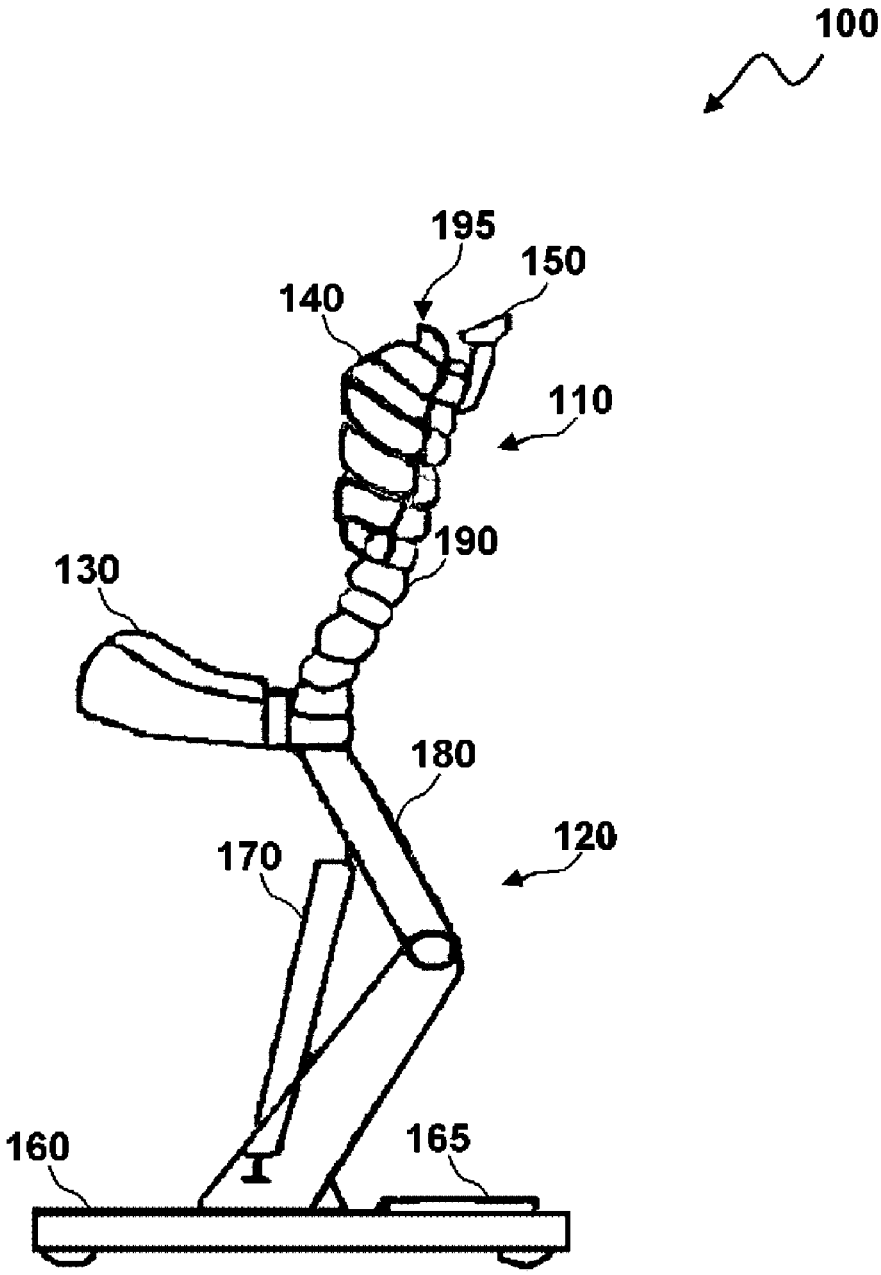
FIG. 1 illustrates a side view of an occupational support chair system, which can be implemented in accordance with a preferred embodiment.

FIG. 1 illustrates a side view of an occupational support chair system 100, which can be implemented in accordance with a preferred embodiment. The occupational support system 100 generally includes an upper support frame 110, a lower support frame 120 and a stabilizing base 160. The upper support frame 110 further includes a breast support 195 that is capable of providing frontal support to a user and alleviating the stress at the user's lower back and shoulders. The upper support frame 110 can be configured in the form of spinal column utilizing individual locking segments 190.

The breast support 195 can be configured to include individual rib segments such as, for example, rib segment 140. The individual locking segments 190 of the upper support frame 110 can change their position with respect to a user's movement on the support chair system 100. The upper support frame 110 can also include a balancing sensor and a motion sensor (not shown), which can be utilized to sense the user's intent of motion so that the system 100 can act in response to the movement of the user and balance the support chair system 100. The upper support frame 110 further includes a removable chin support 150 in order to support the head of the user.

The lower support frame 120 can be composed of a section 180 that communicates with a hydraulic frame system 170. The hydraulic frame system 170 of the lower support frame 120 can be utilized to lift the user on the support chair system 100 into a comfortable position. In general, the hydraulic frame system 170 can be a drive system or transmission system that formulates a hydraulic fluid under pressure to drive the support chair system 100. The hydraulic frame system 170 may comprise a hydraulic pump or motor, valves, piping etc. The hydraulic frame system 170 can function based on Pascal's law. It can be appreciated, of course, that other types of hydraulic frame system are possible.

An adjustable swivel seat 130 can be attached to the upper support frame 110 to take away the fatigue from hours of standing in one spot. The user can be in a standing position, but the weight of the user can be supported by the seat 130. The seat 130 can move with respect to the user's movement through an adjustable and pivoting mechanism. As better seen in FIG. 1, the adjustable swivel seat 130 is fairly wide to support a user seated thereon. The stabilizing base 160 can be designed with a longest portion in front of the hydraulic frame system 170 for balance. The stabilizing base 160 can be disposed in a horizontal plane and extend at a substantially common angle from the lower support frame 120. The stabilizing base 160 can include retractable wheels such as a retractable wheel 320, as shown in FIG. 3B, and a housing 165 for batteries, electronic and computer components.

Figure 2:
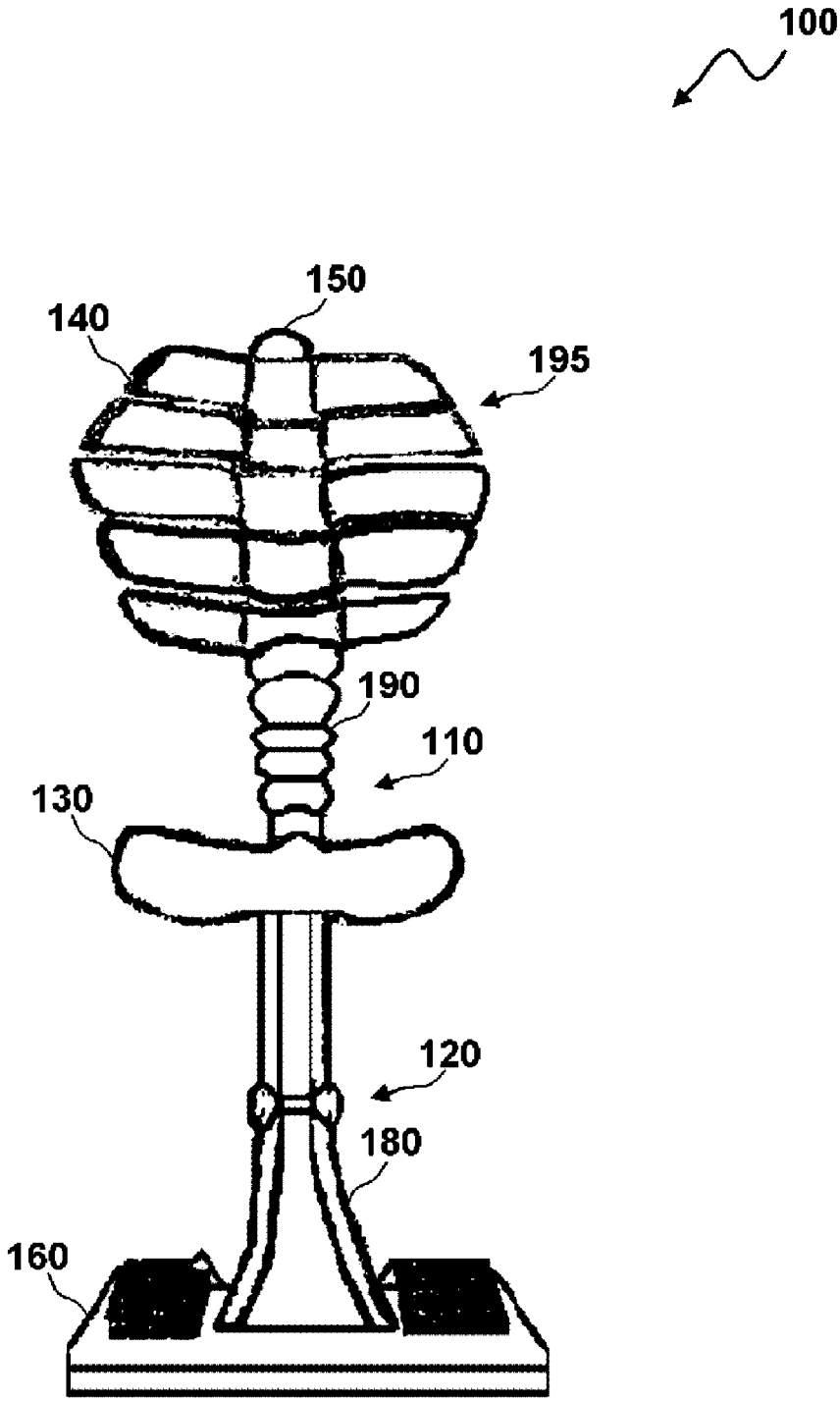
FIG. 2 illustrates a back view of the occupational support chair system, which can be implemented in accordance with a preferred embodiment.

FIG. 2 illustrates a back view of the occupational support chair system 100, which can be implemented in accordance with a preferred embodiment. Note that in FIGS. 1-3, identical or similar parts are generally indicated by identical reference numerals. The support chair system 100 can provide a frontal support to the user's weight as the user is leaning over it and can effectively handle back problems and repetitive motion illness of the user. The upper support frame 110 composed of individual locking segments 190 with the balancing sensor and the motion sensor can be utilized to monitor a user movement and balance the support chair system 100 with respect to the user's movement.

The upper support frame 110 comprises of flexible conduit or serpentine design. Note that the embodiments discussed herein should not be construed in any limited sense. It can be appreciated that such embodiments reveal details of the structure of a preferred form necessary for a better understanding of the invention and may be subject to change by skilled persons within the scope of the invention without departing from the concept thereof. The hydraulic frame system 170 can be utilized to position the seat 130 at a desirable elevated position for comfort of the user. The lower support frame 120 can be adjustable through the hydraulic system 170 which can lift the user into a proper comfortable position. The seat 130 can be utilized to relive the stress from long periods of standing. The breast support 195 can also be padded with technology foam for comfort. The foam technology utilized in breast support 195 can make the support chair system 100 beautiful, unique, practical and cost-effective.

Figure 3A:
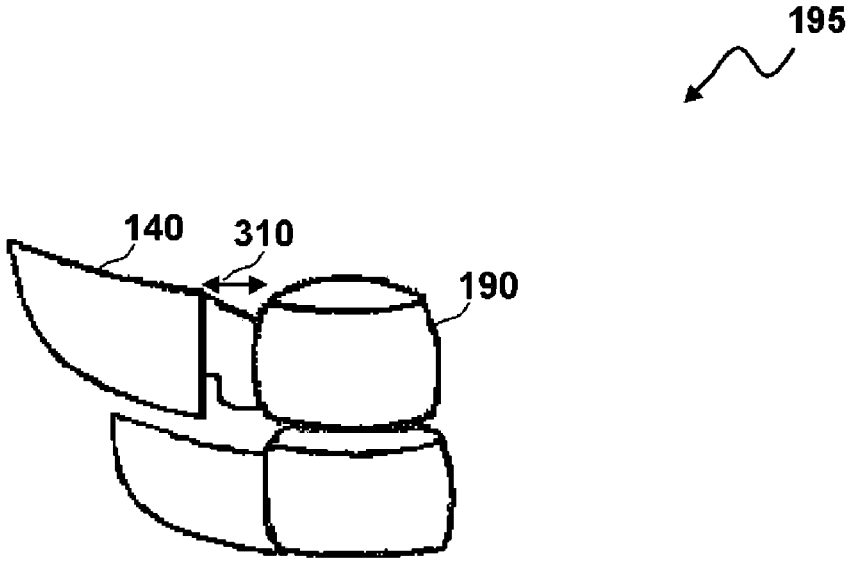
FIG. 3A illustrates a perspective view of a breast support frame illustrating the flexibility of the breast support frame, which can be implemented in accordance with a preferred embodiment.
Figure 3B:
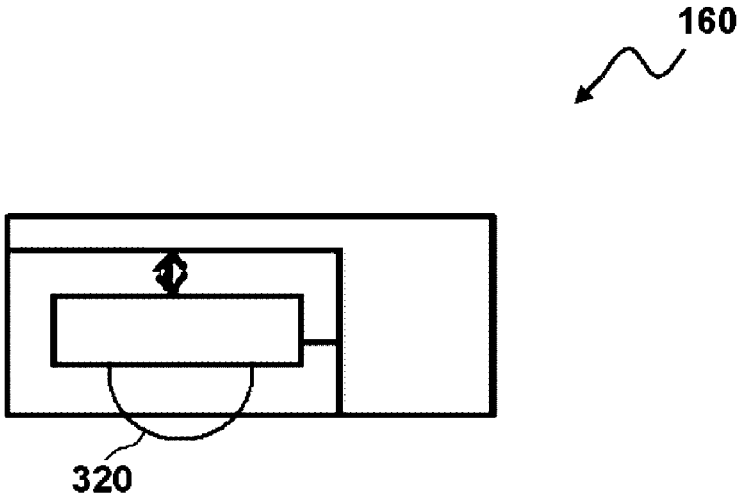
FIG. 3B illustrates a perspective view of a retractable wheel system within a stabilizing base, which can be implemented in accordance with a preferred embodiment.

FIG. 3A illustrates a perspective view of a breast support 195 illustrating the flexibility of the breast support 195, which can be implemented in accordance with a preferred embodiment. The individual rib segments 140 of the breast support 195 can adjust in and out to accommodate larger frames in the support chair system 100. The breast support 195, with the number of individual rib segments 140, can be well padded for comfort for the user. The arrow 310 illustrates the in and out adjustments in the rib segments 140 of the breast support 195 to accommodate larger frames.

FIG. 3B illustrates a perspective view of a retractable wheel 320 within the stabilizing base 160, which can be implemented in accordance with a preferred embodiment. The base segment 160 includes retractable wheels 320 which can be deployed by a user by means of weight. For example, when a user wants to move or swivel the supporting system 100, the user can lift his weight off the seat 130 so that the retractable wheels 320 can come down, as shown in FIG. 3B. When the user attains appropriate position, the weight on the seat 130 can cause the retractable wheels 320 to retract, making the support chair system 100 immobile.

The occupational support chair system 100 can be an ergonomically designed frontal support system that provides a frontal support to a user's weight as the user leans over it. The upper support frame 110 in association with the breast support 195 can take the stress off the user's lower back and shoulders. The lower support system 120 can be adjustable through the hydraulic frame system 170 that can lift the user into an appropriate position. The retractable wheels 320 can be deployed by the user by means of weight. The occupational support system 100 can be utilized in professions such as dental or medical treatment applications, beauty parlors, and barbershops to provide an efficient and comfortable treatment to the user.

It will be appreciated that variations of the above-disclosed and other features and functions, or alternatives thereof, may be desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. An occupational support chair system, comprising:

a lower support frame composed of a dual section hydraulic frame, wherein said dual section hydraulic frame is associated with said lower support frame in order to lift a user into a desired position;

a stabilizing base segment disposed in a horizontal plane and extending at a substantially common angle from said lower support frame;

an upper support frame associated with said stabilizing base segment and said lower support frame, said upper support frame configured in a spinal column utilizing a plurality of individual locking segments, wherein said upper support frame comprises a removable chin support and a breast support to thereby provide a frontal support to said user;

a balancing sensor; and a motion sensor, wherein said balancing sensor and said motion sensor are operable in association with said upper support frame to sense a movement intent of a user and to automatically adjust a position of said support chair system and lock said support chair system in place as movement demands.

2. The system of claim 1 further comprising:

a retractable wheel mechanism; and a housing, wherein said retractable wheel mechanism is deployable via the weight of said user.

3. The system of claim 2 wherein said housing comprises a plurality of batteries and a plurality of electrical and computer components in order to direct said support chair system.

4. The system of claim 1 further comprising:

an adjustable swivel seat associated with said upper support frame to support the weight of said user in order to relieve said user of stress and fatigue stemming from long periods of standing.

5. The system of claim 1 wherein said breast support comprises a plurality of individual rib segments which are adjustable inward and outward to accommodate a plurality of large frames.

6. An occupational support chair system, comprising:

a lower support frame composed of a dual section hydraulic frame, wherein said dual section hydraulic frame is associated with said lower support frame in order to lift a user into a desired position;

a stabilizing base segment disposed in a horizontal plane and extending at a substantially common angle from said lower support frame;

an upper support frame associated with said stabilizing base segment and said lower support frame, said upper support frame configured in a spinal column utilizing a plurality of individual locking segments, wherein said upper support frame comprises a removable chin support and a breast support to thereby provide a frontal support to said user;

a retractable wheel mechanism;

a housing, wherein said retractable wheel mechanism is deployable via the weight of said user; and an adjustable swivel seat associated with said upper support frame to support said weight of said user in order to relieve said user of stress and fatigue stemming from long periods of standing.

7. The system of claim 6 further comprising:

a balancing sensor; and a motion sensor, wherein said balancing sensor and said motion sensor are operable in association with said upper support frame to sense a movement intent of said user and to automatically adjust a position of said support chair system and lock said support chair system in place as movement demands.

8. An occupational support chair system, comprising:

a lower support frame composed of a dual section hydraulic frame, wherein said dual section hydraulic frame is associated with said lower support frame in order to lift a user into a desired position;

a stabilizing base segment disposed in a horizontal plane and extending at a substantially common angle from said lower support frame;

an upper support frame associated with said stabilizing base segment and said lower support frame, said upper support frame configured in a spinal column utilizing a plurality of individual locking segments, wherein said upper support frame comprises a removable chin support and a breast support to thereby provide a frontal support to said user;

balancing sensor; and a motion sensor, wherein said balancing sensor and said motion sensor are operable in association with said upper support frame to sense a movement intent of said user and to automatically adjust a position of said support chair system and lock said support chair system in place as movement demands.

9. The system of claim 8 further comprising:

a retractable wheel mechanism; and a housing, wherein said retractable wheel mechanism is deployable via the weight of said user.

10. The system of claim 8 further comprising:

an adjustable swivel seat associated with said upper support frame to support the weight of said user in order to relieve said user of stress and fatigue stemming from long periods of standing.

11. The system of claim 8 wherein said breast support comprises a plurality of individual rib segments which are adjustable inward and outward to accommodate a plurality of large frames.

12. The system of claim 8 wherein said housing comprises a plurality of batteries and a plurality of electrical and computer components in order to direct said support chair system.

13. The system of claim 8 further comprising a retractable wheel mechanism.

14. The system of claim 13 further comprising a housing, wherein said retractable wheel mechanism is deployable via the weight of said user.

15. The system of claim 8 further comprising:

an adjustable swivel seat associated with said upper support frame to support the weight of said user in order to relieve said user of stress and fatigue stemming from long periods of standing, wherein said breast support comprises a plurality of individual rib segments which are adjustable inward and outward to accommodate a plurality of large frames.

16. The system of claim 8 further comprising:

a retractable wheel mechanism;

a housing, wherein said retractable wheel mechanism is deployable via the weight of said user; and an adjustable swivel seat associated with said upper support frame to support the weight of said user in order to relieve said user of stress and fatigue stemming from long periods of standing.

17. The system of claim 16 wherein said breast support comprises a plurality of individual rib segments which are adjustable inward and outward to accommodate a plurality of large frames.

* * * * *